United States Patent [19]

Selvin

[11] Patent Number: 4,598,959

[45] Date of Patent: Jul. 8, 1986

[54] ELECTRICAL CONNECTOR GROUNDING RING

[75] Inventor: Gerald J. Selvin, Huntington Beach, Calif.

[73] Assignee: International Telephone and Telegraph Corporation, New York, N.Y.

[21] Appl. No.: 548,797

[22] Filed: Nov. 4, 1983

[51] Int. Cl.[4] ..... H01R 4/66; H01R 13/648

[52] U.S. Cl. ..... 339/14 R; 339/143 R

[58] Field of Search ..... 339/94 R, 94 M, 14 R, 339/143 R, 89 R, 89 M, 90 R

[56] References Cited

U.S. PATENT DOCUMENTS

| | | | |
|---|---|---|---|
| 4,126,372 | 11/1978 | Hashimoto et al. | 339/143 R X |
| 4,248,492 | 2/1981 | Snyder | 339/143 R X |
| 4,330,166 | 5/1982 | Cooper et al. | 339/143 R |
| 4,349,241 | 9/1982 | Juris et al. | 339/143 R |

*Primary Examiner*—Eugene F. Desmond

*Attorney, Agent, or Firm*—T. L. Peterson; R. C. Turner

[57] ABSTRACT

An electrical connector containing a grounding ring in the form of a metal bellows which is axially compressed when the mating halves of the connector are interengaged. The bellows provides a windowless EMI/RFI grounding shield for the connector.

9 Claims, 4 Drawing Figures

ELECTRICAL CONNECTOR GROUNDING RING

BACKGROUND OF THE INVENTION

The present invention relates generally to an electrical connector and, more particularly, to a grounding ring for an electrical connector which provides protection against RFI/EMI signals.

The use of shielding in electrical connectors to prevent unwanted radio frequency and electro-magnetic signals (RFI/EMI) from interfering with signals being carried by the contacts in connectors is well known. U.S. Pat. Nos. 3,521,222; 3,678,445; 4,106,839 and 4,239,318 disclose annular shields formed of sheet metal with resilient fingers which electrically engage the outer surface of the plug barrel and the inner surface of the receptacle shell of the electrical connector.

U.S. Pat. No. 3,835,443 discloses an electrical connector shield comprising a helically coiled conductive spring which is interposed between facing annular surfaces on the mating halves of an electrical connector. The spring is coiled in such a manner that the convolutions thereof are slanted at an oblique angle to the center axis of the connector members. When the connector members are mated, the spring is axially flattened to minimize the gap between the convolutions thereof and to provide a wiping electrical engagement with the annular surfaces on the mating halves of the connector.

U.S. Pat. No. 4,033,654 discloses another form of slant coil spring shield for an electrical connector in which the spring is mounted in an internal groove formed in the receptacle shell. The convolutions of the spring are arranged in such a fashion that they will collapse radially when the plug barrel is inserted into the receptacle shell.

Each of the foregoing shielding devices has the disadvantage that slots or gaps exist in the device which allow some EMI/RFI leakage into the connector. Also, the devices are costly and damage sensitive.

U.S. Pat. No. 3,336,566 discloses a coaxial connector embodying a two layer contact member for preventing signal leakage from the interior of the connector. The two layers embody reversely bent, overlapping spring fingers. The fingers of one layer are offset from the fingers of the other layer so that the fingers of each layer overlie the boundaries formed between the fingers of the other layer to provide a generally continuous contact member. The resilient fingers expand radially outwardly when a tubular conductive member on a coaxial cable is pushed into the interior of the contact member. While this double layer arrangement provides a peripherally continuous shield, it is expensive to manufacture and the slits in the two layers of the contact member which form the resilient fingers provide sharp edges which is undesirable.

It is the object of the present invention to provide a simple, inexpensive and effective grounding ring for an electrical connector which provides a windowless EMI/RFI shield between the mating halves of the electrical connector at their interface.

SUMMARY OF THE INVENTION

According to a principal aspect of the present invention, there is provided an electrical connector comprising first and second mating connector members each including a conductive shell. The shells have forwardly facing annular surfaces thereon. A conductive bellows is positioned between the annular surfaces providing a grounding connection between the shells. The bellows is axially compressed when the connector members are mated. The spring resistance that is built up in the bellows during its compression insures that intimate electrical contact is provided between the connector members of the assembly. Furthermore, because a bellows has a continuous wall, a windowless EMI/RFI shield is provided at the interface of the connector members. Further, the bellows has a smooth surface and, therefore, is difficult to "snag" and damage as are the prior art shields.

DESCRIPTION OF THE PREFERRED EMBODIMENT

Figure 1:
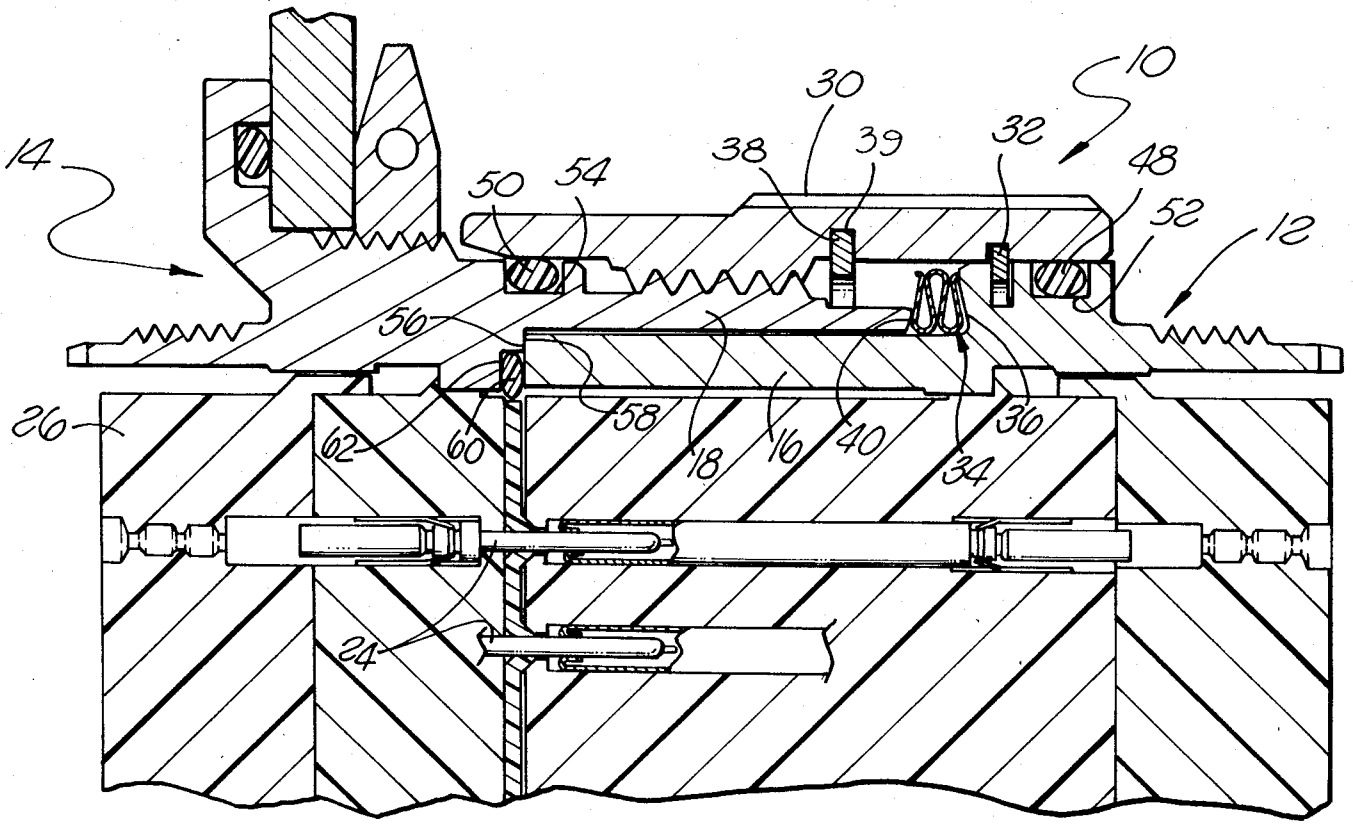
FIG. 1 is a partial, longitudinal sectional view through an electrical connector, shown in its fully mated condition, embodying the bellows grounding ring to the present invention.

Referring now to the drawing in detail, there is shown in FIG. 1 an electrical connector, generally designated 10, comprising a plug connector member 12 and a receptacle connector member 14. The plug connector member comprises a cylindrical barrel 16 which is telescopically mounted in the front end of the cylindrical shell 18 of the receptacle connector member. A plurality of socket contacts 20 are axially positioned in an insulator 22 in the barrel 16. Each such contact 20 receives a pin contact 24 mounted in an insulator 26 in a receptacle connector member 14. A coupling nut 30 is retained on the barrel 16 of the plug connector member by a retaining ring 32. The forward end of the coupling nut is threadedly engaged with the shell 18 of the receptacle connector member 14. A bayonet coupling could be used instead, if desired.

In accordance with the invention, a metal bellows 34 is mounted in the plug connector member 12. The bellows surrounds the shell 16 in front of a forwardly facing annular surface 36 thereon. The bellows is retained in the plug connector member by a retaining ring 38 mounted in an internal groove 39 in the coupled nut 30. The ring 38 is spaced a short distance in front of the bellows so that the bellows is loosely mounted in the plug connector member. The axial length of the bellows is greater than the distance between the surface 36 on the plug shell 16 and a forwardly facing abutment surface 40 on the front end of the receptacle shell 18 when the connector members are fully mated.

Figure 2:
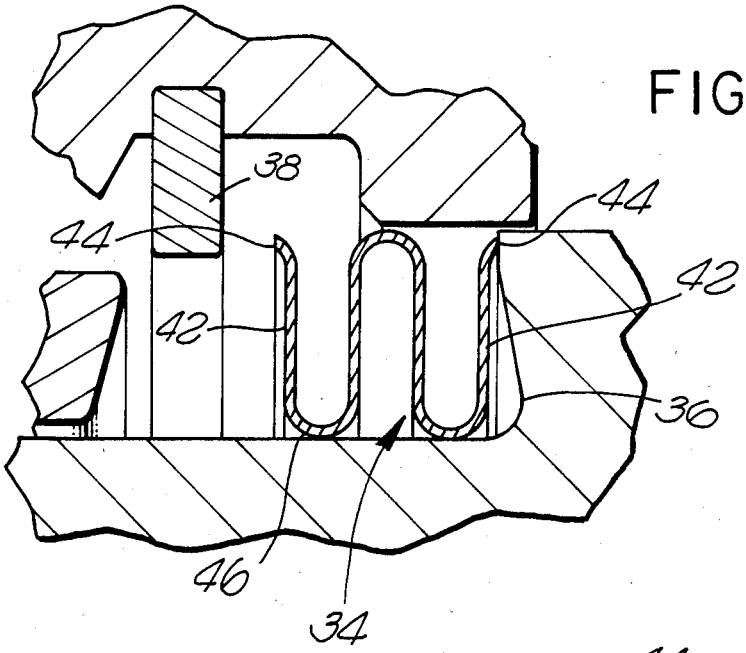
FIG. 2 is a fragmentary, longitudinal sectional view showing the bellows in an unstressed condition when the two halves of the connector are disengaged.
Figure 4:
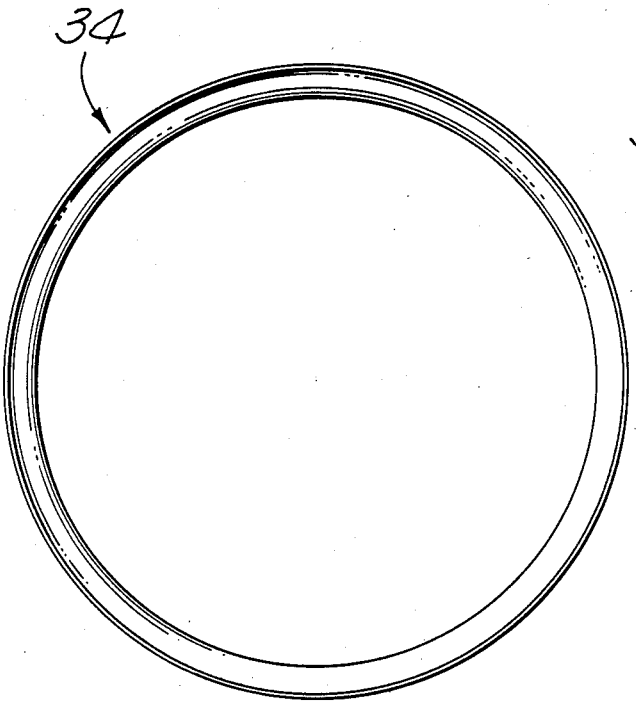
FIG. 4 is a front elevational view of the bellows grounding ring.
Figure 3:
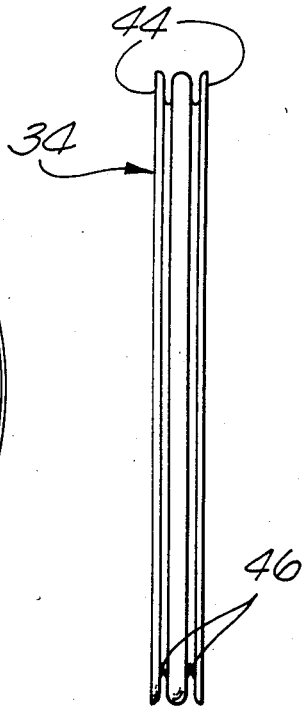
FIG. 3 is a side view of the bellows grounding ring.

FIG. 2 illustrates the bellows in an unstressed conditioned when the plug and receptacle members of the connector are disengaged. The bellows embodies generally parallel ring portions 42 at its opposite ends which extends radially outwardly and terminate in circular edges 44. Preferably the forwardly facing surface 36 on the plug barrel 16 tapers forwardly and outwardly while the forwardly facing abutment surface 40 on the receptacle shell likewise tapers forwardly and outwardly so that the two surfaces that engage the opposite ends of the bellows taper toward each other in the same direction, namely, toward the circular edges 44 of the outer ring portions of the bellows. As a consequence, when the mating halves of the connector are interengaged, the inclined abutment surfaces 36 and 40 will distribute compressive forces early in the deflection cycle of the bellows thereby minimizing high local forces which could cause permanent deformation of the bellows, for example, in the region of the bends 46 in the corrugated wall of the bellows as might occur if the abutment surfaces were parallel to each other. It will be appreciated, however, that the abutment surfaces need not be tapered and the bellows could still be axially compressed to provide a good electrical connection between the plug barrel 16 and receptacle shell 18 of the connector.

The bellows may be easily installed in the plug barrel 16, and requires no permanent electrical connection thereto. The bellows is progressively compressed upon mating of the plug and receptacle members, taking up any tolerance accumulations which may exist between the two members. The spring resistance that builds up upon compression of the bellows assures that intimate electrical contact is provided between the plug barrel and receptacle shell. Such electrical contact is maintained between the mated halves of the connector even though the connector may be subjected to high vibration or numerous matings and unmatings of the connector halves.

The bellows may be formed of any suitable resilient conductive material, such as beryllium copper, aluminum and stainless steel. The bellows has the significant advantage that it is very simple in construction, inexpensive to produce and install in the connector, and provides a windowless EMI/RFI grounding shield for the connector. Furthermore, the tightly compressed bellows may provide an effective environmental seal between the mating halves of the connector, which will prevent intrusion into the interior of the connector of moisture, dust, etc.

If desired, sealing rings 48 and 50, such as elastomeric O-rings, may be mounted in annular grooves 52 and 54, respectively, in the plug barrel and receptacle shell to provide an environmental seal between those parts and the coupling nut 30. Also, the forward end 56 of the barrel 16 may be dimensioned to have a butt engagement with a forwardly facing annular shoulder 58 on the interior of the receptacle shell to provide a secondary ground connection between the barrel and shell. Also, an elastomeric sealing ring 60 may be interposed between the forward end 56 of the barrel 16 and the bottom of a groove 62 interior of the surface 58 of the receptacle shell to provide additional environmental sealing between the mating halves of the connector.

It will be appreciated from the foregoing that the connector of the present invention is capable of withstanding severe environmental conditions, and the peripherally continuous grounding ring between the mating halves of the connector will provide reliable, long term protection against unwanted external EMI/RFI signals.

What is claimed is:

1. An electrical connector comprising:

first and second mating connector members each including a conductive shell;

said shells having forwardly facing annular surfaces thereon;

a conductive bellows positioned between said surfaces providing a grounding connection between said shells;

said bellows having rounded folds that cause opposite sides of a fold to remain spaced apart by more than two adjacent locations of the bellows that are near different folds; and said bellows being axially compressed when said connector members are mated.

2. An electrical connector as set forth in claim 1 wherein:

said bellows is constructed of metal.

3. An electrical connector as set forth in claim 1 wherein:

a first of said shells has a substantially cylindrical outer surface, and said bellows has a radially inner side that closely surrounds said cylindrical surface;

each of said annular surfaces engages a location on said bellows which is spaced from the radially inner side of the bellows by more than the thickness of the material of the bellows.

4. An electrical connector as set forth in claim 1 wherein:

said annular surfaces are tapered, and engage portions of said bellows that are spaced from the radially innermost portions of the bellows by more than the thickness of the material of the bellows.

5. An electrical connector as set forth in claim 1 wherein:

said bellows embodies ring portions at its opposite ends, said ring portions extending radially in the same direction and terminating in circular edges; and at least one of said annular surfaces engages one of said ring portions and said annular surfaces are tapered toward each other along a radially outward direction.

6. An electrical connector as set forth in claim 1 wherein:

said bellows embodies ring portions at its opposite ends, said ring portions being generally parallel to each other when said connector members are unmated; and said annular surfaces are angled towards each other in a radially outward direction, the deflect said bellows when said connector members are mated.

7. An electrical connector as set forth in claim 1 wherein:

said bellows surrounds the shell of one of said connector members;

a coupling ring surrounds said bellows and said one connector member shell; and a second ring is on said coupling ring and extends radially inwardly far enough to engage the radially outer portion of the bellows to limit axial movement of said bellows to retain it.

8. An electrical connector as set forth in claim 7 wherein:

said second ring comprises a resilient retaining member mounted in an internal groove in said coupling ring.

9. An electrical connector member comprising:

a conductive shell with a substantially cylindircal outer portion that has a forward end, said shell surrounding an insulator adapted to contain electrical contacts;

said shell having a forwardly facing annular surface thereon that has a larger diameter than said forward end and that lies rearward of said forward end; and a coupling nut which is rotatably mounted around said shell and which has a great enough inside diameter to leave a space between the outer surface of said shell and the inner surface of said nut at locations forward of said annular surface of said shell;

a conductive metal bellows having multiple folds that each closely surround said cylindrical portion of said shell in front of said annular surface so the cylindrical surface confines the bellows to substantially only axial movement, said bellows being adapted to be axially compressed when the connector member is mated with a second connector member, and said coupling nut having an inwardly-extending ring spaced forward of said bellows to limit forward movement of said bellows.

* * * * *